US008764143B2

(12) United States Patent
Ieiri

(10) Patent No.: US 8,764,143 B2
(45) Date of Patent: Jul. 1, 2014

(54) IMAGE FORMING APPARATUS AND DRIVE-VOLTAGE GENERATING CIRCUIT

(75) Inventor: Yuji Ieiri, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 127 days.

(21) Appl. No.: 13/468,509

(22) Filed: May 10, 2012

(65) Prior Publication Data

US 2012/0306952 A1 Dec. 6, 2012

(30) Foreign Application Priority Data

Jun. 1, 2011 (JP) ..... 2011-123316

(51) Int. Cl.
*B41J 29/38* (2006.01)

(52) U.S. Cl.
USPC ..... 347/10; 347/5; 347/9

(58) Field of Classification Search
USPC ..... 347/5, 9, 10
See application file for complete search history.

(56) References Cited

U.S. PATENT DOCUMENTS

| | | | | |
|---|---|---|---|---|
| 4,431,972 | A * | 2/1984 | Ishii et al. | 330/267 |
| 4,864,249 | A * | 9/1989 | Reiffin | 330/263 |
| 6,657,496 | B2 * | 12/2003 | Chen et al. | 330/263 |
| 6,830,303 | B2 | 12/2004 | Tamura | |
| 6,882,225 | B2 * | 4/2005 | Deletraz | 330/263 |
| 7,114,791 | B2 * | 10/2006 | Umeda | 347/9 |
| 7,764,123 | B2 * | 7/2010 | Kimura | 330/264 |
| 2003/0122899 | A1 | 7/2003 | Kojoh et al. | |
| 2007/0070102 | A1 | 3/2007 | Takata | |

FOREIGN PATENT DOCUMENTS

| | | |
|---|---|---|
| CN | 2563833 Y | 7/2003 |
| CN | 2817213 Y | 9/2006 |
| JP | 7-148920 | 6/1995 |
| JP | 2003-300318 | 10/2003 |
| JP | 2004-195792 | 7/2004 |
| JP | 3965700 | 6/2007 |
| JP | 2009-6505 | 1/2009 |

OTHER PUBLICATIONS

Extended European Search Report issued Sep. 19, 2012 in Patent Application No. 12169934.2.
Office Action (with English translation) issued on Feb. 25, 2014, in counterpart Chinese Appln No. 201210179094.4 (16 pages).

* cited by examiner

*Primary Examiner* — Laura Martin
*Assistant Examiner* — Jeremy Bishop
(74) *Attorney, Agent, or Firm* — Oblon, Spivak, McClelland, Maier & Neustadt, L.L.P.

(57) ABSTRACT

An image forming apparatus includes: a plurality of heads, each of which includes a capacitive load used as an actuator for discharging ink; a drive-voltage generating circuit that outputs a drive voltage to be applied to the actuator and includes a plurality of current amplifying circuits; and a plurality of head drivers that control the actuators of the heads. Each of the current amplifying circuits is configured to include a plurality of bipolar transistors and to operate so as to equalize output current loads of the bipolar transistors included in the current amplifying circuits, and waveforms of the drive voltages output from the current amplifying circuits are combined to form a combined waveform of the drive voltages to be applied to each of the head drivers.

6 Claims, 9 Drawing Sheets

IMAGE FORMING APPARATUS AND DRIVE-VOLTAGE GENERATING CIRCUIT

CROSS-REFERENCE TO RELATED APPLICATIONS

The present application claims priority to and incorporates by reference the entire contents of Japanese Patent Application No. 2011-123316 filed in Japan on Jun. 1, 2011.

BACKGROUND OF THE INVENTION

1. Field of the Invention

The present invention relates generally to image forming apparatuses and drive-voltage generating circuits.

2. Description of the Related Art

Conventionally, an inkjet printer that uses a piezoelectric element as an actuator apply a voltage waveform that is called a drive waveform to the piezoelectric element so as to control a droplet size and an discharging speed of an ink droplet. The maximum value of an electric current supplied to the piezoelectric element increases when the piezoelectric element has a large capacitive load, when a voltage fluctuation width of the drive waveform has increased, or when a slew rate of the drive waveform is steep. Accordingly, a drive-waveform generating circuit is required to correspond to a high-current output.

Known circuit configurations for corresponding to the high-current output include a configuration in which each transistor included therein is changed to that of a higher rated current and a configuration in which a plurality of amplifier circuits is arranged in parallel with each other so as to disperse current loads among the amplifier circuits.

Disclosed in Japanese Patent Laid-open Publication No. 2006-088695 is an apparatus that includes a plurality of drive-waveform generating circuits for a purpose of preventing overloading a voltage-waveform generating circuit. That is, the apparatus controls as to which one of the drive-waveform generating circuits supplies a drive waveform to which one of the piezoelectric elements so that a load on each of the drive-waveform generating circuits remains within a predetermined level.

However, there remain problems in the conventional circuit configurations. For instance, when transistors in the configuration are replaced with high rated current transistors, a frequency response characteristic decreases, so that a steep drive waveform cannot be output. When a load in the configuration is dispersed to a plurality of drive circuits, concentration of the load on some particular circuits may occur; accordingly, low rated transistors cannot be used, making the production cost of the configuration to be high. A technique such as that disclosed in Japanese Patent Laid-open Publication No. 2006-088695 can result in an increase in cost because of an additional component and an increase in complexity of a circuit related to the addition of a switching circuit for controlling signals necessary for controlling a load balance.

Therefore, there is a need for providing an image forming apparatus and a drive-voltage generating circuit in which a current amplifying circuit for driving an actuator, which is implemented by using a capacitive load, in the image forming apparatus does not include high-rated-current (costly) components but has a required characteristic and is configured by components with a small parts count.

SUMMARY OF THE INVENTION

It is an object of the present invention to at least partially solve the problems in the conventional technology.

An image forming apparatus includes: a plurality of heads, each of which includes a capacitive load used as an actuator for discharging ink; a drive-voltage generating circuit that outputs a drive voltage to be applied to the actuator and includes a plurality of current amplifying circuits; and a plurality of head drivers each of which controls each of the actuators of the heads. Each of the current amplifying circuits is configured to include a plurality of bipolar transistors and to operate so as to equalize output current loads of the bipolar transistors included in the current amplifying circuits, and waveforms of the drive voltages output from the current amplifying circuits are combined to form a combined waveform of the drive voltages to be applied to each of the head drivers.

A drive-voltage generating circuit outputs a drive voltage to be applied to an actuator which is used as a capacitive load for discharging ink in an image forming apparatus. The image forming apparatus has a plurality of heads, and each of the heads is driven by the actuator. The drive-voltage generating circuit includes a plurality of current amplifying circuits. Each of the current amplifying circuits is configured to include a plurality of bipolar transistors and to operate so as to equalize output current loads of the bipolar transistors included in the current amplifying circuits, and waveforms of the drive voltages output from the current amplifying circuits are combined to form a combined waveform of the drive voltages to be applied to each of the head drivers.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
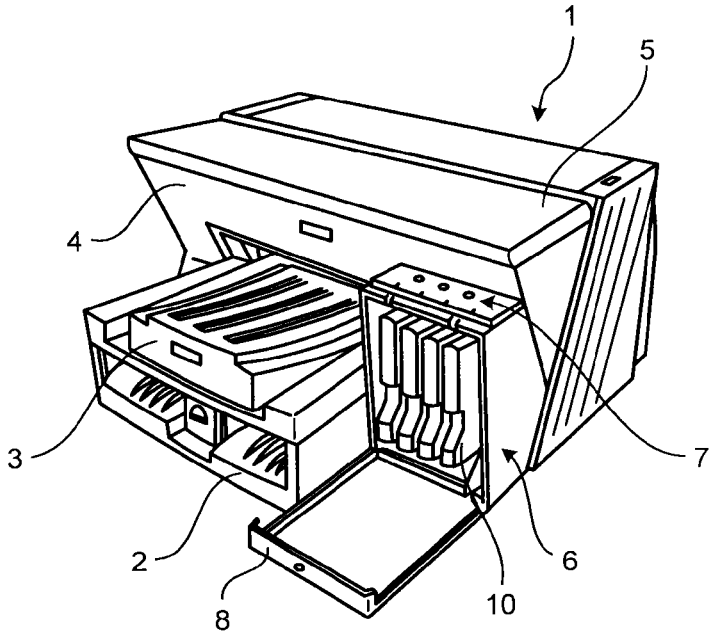
FIG. 1 is a diagram illustrating an example of an appearance of an inkjet recording apparatus according to an embodiment.

FIG. 1 is a diagram illustrating an example of an appearance of an inkjet recording apparatus according to an embodiment. An inkjet recording apparatus 1 illustrated in FIG. 1 includes a paper feed tray 2, a discharge tray 3, a cartridge loading section 6, and an operating section 7 which are arranged in an apparatus body.

The paper feed tray 2 is provided to feed paper which is a recording medium placed in the inkjet recording apparatus 1. Sheets of the paper on which images have been recorded (formed) are stacked on the discharge tray 3.

The cartridge loading section 6 is disposed on a side of one end of a front surface 4 of the inkjet recording apparatus 1. The cartridge loading section 6 is arranged to protrude from the front surface 4 and to remain to be lower than a top surface 5 of the inkjet recording apparatus 1.

The operating section 7 that includes an operation key and a display is arranged on an upper surface of the cartridge loading section 6 that protrudes from the front surface 4. The cartridge loading section 6 includes a front cover 8 that can be opened and closed so as to load or unload ink cartridges 10.

Only four pieces (for coloring agents of black, cyan, magenta, and yellow) of the ink cartridges 10 are illustrated in FIG. 1; however, in addition thereto, one to four processing-liquid cartridges (for coloring inks that require processing liquid) are additionally loaded. Meanwhile, there are some coloring agents, such as a coloring agent having high discharging reliability, for which processing liquid is not required.

Figure 2:
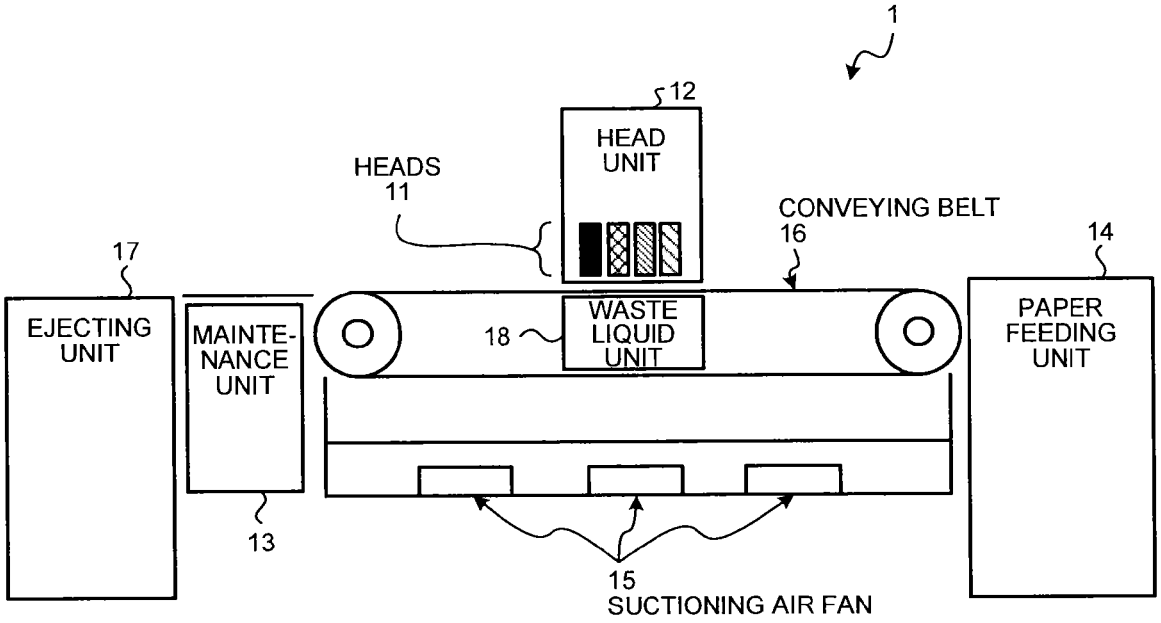
FIG. 2 is a diagram schematically illustrating the configuration of the inkjet recording apparatus according to the embodiment.

A schematic configuration of the inkjet recording apparatus according to the embodiment is roughly described below with reference to FIG. 2. FIG. 2 is a diagram illustrating the schematic configuration of the inkjet recording apparatus according to the embodiment.

The inkjet recording apparatus 1 illustrated in FIG. 2 has a configuration which is also called a line printer; when performing printing, the inkjet recording apparatus 1 arranges, in a fixed manner, a print head 11 (hereinafter, "head 11") having a width corresponding to a print width and performs printing on a recording sheet conveyed thereto using the head 11. The head 11 includes a plurality of piezoelectric elements for discharging ink and the plurality of nozzles corresponding to the plurality of the piezoelectric elements. Typically, a print head unit 12 (hereinafter, referred to as a "head unit 12") includes a plurality of heads 11 arranged in a zigzag pattern. Alternatively, the head unit 12 may include one unit as a line head.

The head unit 12 usually includes a plurality of the heads 11 for discharging ink of colors of yellow (Y), cyan (C), magenta (M), and black (Bk) by arranging the heads 11 in a sheet conveying direction and setting an ink discharging direction thereof to be downward. Meanwhile, the number of ink colors and the order in which the heads 11 are arranged in the sheet conveying direction are not limited thereto.

The head unit 12 includes a sub tank (not shown) of each color for supplying ink to the corresponding one of the heads 11. Ink is supplied to each of the sub tanks from a corresponding one of the ink cartridges (ink tanks) loaded in the cartridge loading section via an ink supply tube. Meanwhile, the cartridge loading section includes a feed pump unit for feeding the ink from the ink cartridges (ink tanks).

The head unit 12 of the inkjet recording apparatus 1 is usually on standby in a state in which a maintenance unit 13 caps the head unit 12 to prevent ink at nozzle opening portions of the heads 11 from drying. When print start is designated by a user, the head unit 12 is uncapped from the maintenance unit 13, and moves to a home position for starting printing. Printing is usually performed with the head unit 12 fixed at the home position. When printing is completed and the head unit 12 is to be capped, the head unit 12 is brought to a standby state by being moved to a position of the maintenance unit 13 to be capped therewith. When printing is not to be performed for a long period of time or the inkjet recording apparatus 1 is to be powered off, the heads 11 are kept in a state in which the nozzle opening portions thereof are capped with the maintenance unit 13.

The paper feed tray 2, onto which sheets are to be loaded, is mounted on a paper feeding unit 14 illustrated in FIG. 2. The paper feeding unit 14 is configured to separate one sheet from the sheets stacked on the paper feed tray 2 to feed the sheets one piece at a time. The paper feed tray 2 is configured to be capable of housing sheets of any desired size. The paper feeding unit 14 is configured to detect a sheet(s) with a sensor when the sheet is loaded thereonto and also to determine a sheet size and an orientation (portrait or landscape) of the sheet. The paper feeding unit 14 is also configured to detect absence of a sheet from the paper feed tray or an error occurred in sheet feeding with a sensor. The paper feeding unit 14 can change an interval between sheets during continuous printing, and can adjust the interval as required depending on a sheet size and/or a conveying speed (print speed).

The thus-fed sheet is sucked onto a conveying belt 16 having an air-suctioning function implemented by a negative pressure that is generated by a suctioning air fan 15 and conveyed one by one. When the sheet passes through the head unit 12, ink is discharged from the heads 11 onto the sheet, thereby printing characters and an image thereon. The printed sheet is conveyed to a discharging unit 17 and stacked on the discharge tray 3.

Although not shown in FIG. 1, a waste liquid unit 18 that stores waste ink wasted for idle discharging is arranged at a predetermined position below the head unit 12. Usually, the waste liquid unit 18 is configured to have a sensor that detects when the wasted ink unit becomes full, thereby enabling the wasted ink to be discarded as waste liquid by a user.

Figure 3:
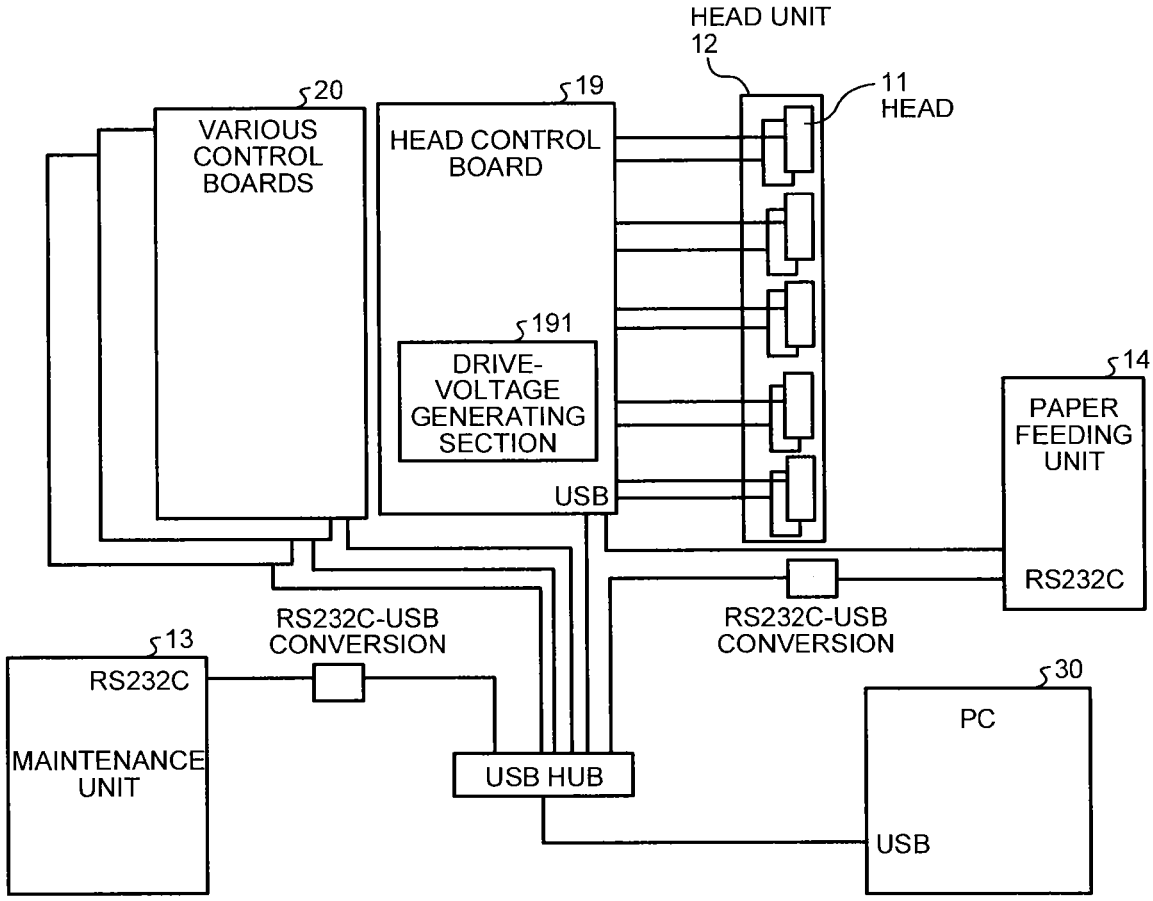
FIG. 3 is a diagram illustrating an electrical system configuration of the inkjet recording apparatus according to the embodiment.

An electrical system configuration of the inkjet recording apparatus 1 according to the embodiment is described below with reference to FIG. 3. FIG. 3 is a diagram illustrating the electrical system configuration of the inkjet recording apparatus 1 according to the embodiment.

The inkjet recording apparatus 1 illustrated in FIG. 3 roughly includes the head unit 12 that includes the heads 11 and performs printing, the paper feeding unit 14 that feeds a sheet from the paper feed tray 2 and conveys the sheet, the maintenance unit 13 that performs maintenance of the heads 11 and the like, a head control board 19 that controls the head unit 12, and various control boards 20 that control each unit.

The head control board 19 controls discharging of an ink droplet and an amount of the ink droplet to be discharged from each of the piezoelectric elements of the heads 11 based on print data supplied from an external personal computer (PC) 30. In this control, a drive-voltage generating section 191 generates a drive voltage for driving the piezoelectric elements, as will be described later. The head control board 19 and the various control boards 20 are control units that include a central processing unit (CPU) and a memory which is a non-volatile memory, such as a flash memory, or a volatile memory, such as a dynamic random access memory (DRAM). Control programs for controlling the head unit 12 and the like are stored in the memory of the head control board 19.

Each unit is connected to the PC 30 which is an information processing apparatus over a universal serial bus (USB) communication through which data and commands are exchanged between the unit and the PC 30. In the inkjet recording apparatus 1, the paper feeding unit 14 and the maintenance unit 13 perform communications using an RS232C interface; however, the RS232C interface is converted to USB for commonalizing the communications. The conversion is performed using a commercially available conversion cable that allows all the units to perform the USB communications with the PC 30. Accordingly, the PC 30 can recognize all the units connected thereto as different USB devices and communicate with and control each of the units using an identification ID assigned to each unit.

The head unit 12 is configured such that the heads 11 and the head control board 19 that can control the heads 11 are connected over the USB communications with each other, and the USB communications are assembled into one USB communication via the USB Hub to be connected to the PC 30. FIG. 3 illustrates an example in which a single piece of the head control board 19 controls ten pieces of the heads 11 arranged in a line; however, the number of pieces of the heads 11 to be controlled by a single piece of the head control board 19 depends on a print size and the like and therefore is not limited to ten.

The configuration described above makes it possible to reconfigure the heads 11 only by connecting a head control board 19A adapted to the reconfigured heads 11. Furthermore, when viewed from the PC 30, the head control board 19A is recognized as a USB device, and therefore, the PC 30 can easily adapt to a new configuration as before.

In the present embodiment, the paper feeding unit 14 is connected to the head control board 19 such that predetermined discrete signals output from the paper feeding unit 14 are transmitted to the head control board 19 in parallel. Accordingly, addition of a head control board 19B to the head control board 19 can be performed easily by connecting the discrete signals to the head control boards 19 and 19B in parallel with each other.

Figure 4:
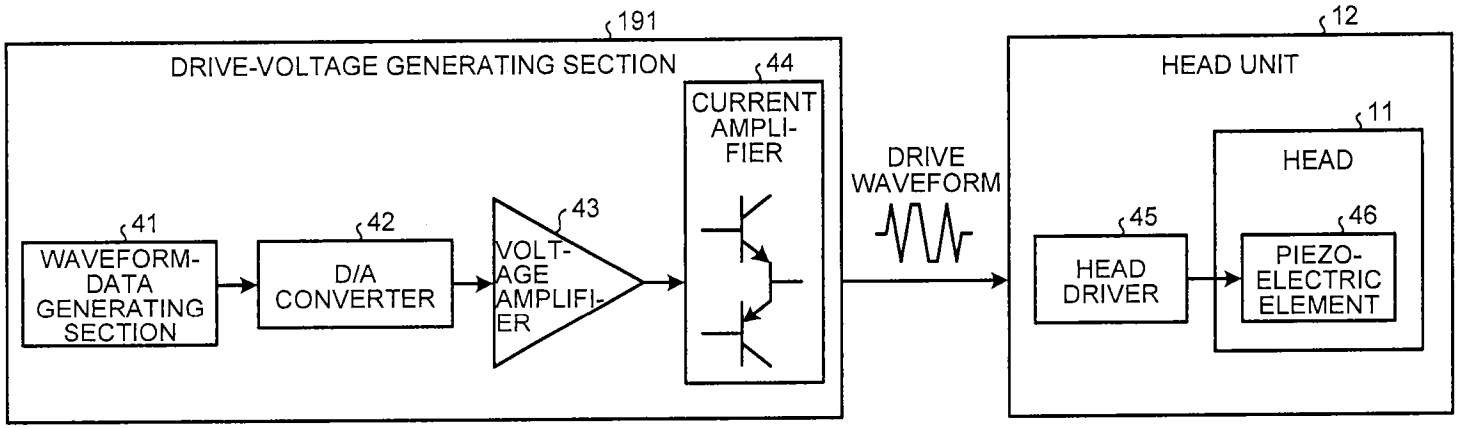
FIG. 4 is a diagram illustrating a drive-voltage generating section.

The drive-voltage generating section 191 is described below. FIG. 4 is a diagram illustrating the drive-voltage generating section 191.

The drive-voltage generating section 191 includes a waveform-data generating section 41, a digital-to-analog (D/A) converter 42, a voltage amplifier 43 such as an operational amplifier that serves as a voltage amplifier circuit, and a current amplifier circuit serving as a current amplifying circuit 44 (hereinafter, referred to as a "current amplifier 44"). The head unit 12 includes piezoelectric elements 46 that form the heads 11 and head drivers 45 that control discharging of ink droplet performed by the piezoelectric elements 46 according to a drive waveform supplied from the drive-voltage generating section 191 and a predetermined control signal (gradation data) supplied from the head control board 19. The waveform-data generating section 41 may be implemented using a nonvolatile memory that stores waveform data, or, alternatively, may be implemented such that the CPU provided in the head control board 19 generates waveform data according to a predetermined control program.

In the drive-voltage generating section 191 configured as described above, the waveform data generated by the waveform-data generating section 41 is subjected to D/A conversion performed by the D/A converter 42 and then subjected to voltage amplification performed by the voltage amplifier 43. The voltage-amplified waveform is subjected to current amplification performed by the current amplifier 44 and then sent to the head driver 45. This voltage waveform output from the drive-voltage generating section 191 to the side of the head unit 12 is a waveform for driving the piezoelectric elements 46 and is referred to as a drive waveform.

Figure 5:
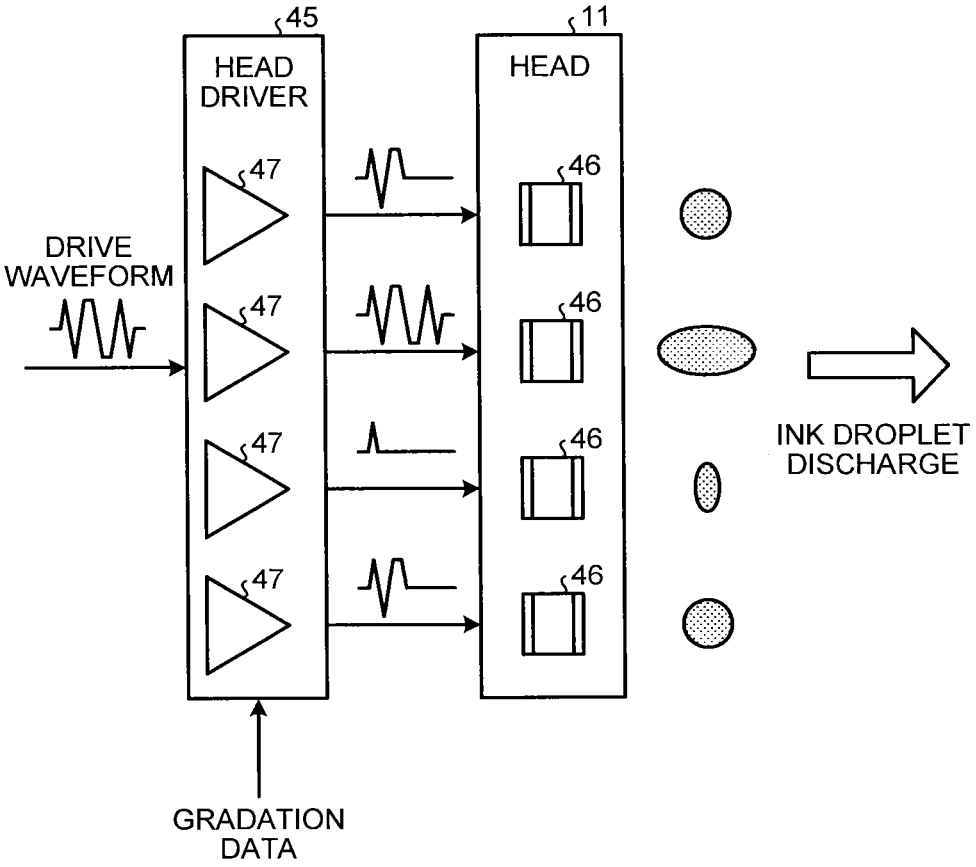
FIG. 5 is a diagram illustrating a method for driving piezoelectric elements by a drive waveform.

A method for driving the piezoelectric elements 46 by the drive waveform is described below with reference to FIG. 5. FIG. 5 is a diagram illustrating the method for driving the piezoelectric elements 46 by the drive waveform.

In the inkjet recording apparatus 1 that uses the piezoelectric elements 46 as actuators, the drive waveform and the gradation data are input to the head driver 45, from which the drive waveform is selectively transferred to the piezoelectric elements 46 according to an image to be formed, thereby causing the targeted piezoelectric element 46 to discharge an ink droplet at a designated gradation.

Meanwhile, the electrical current to be output from the current amplifier 44 increases as the number of the piezoelectric elements 46 to be driven increases and as fluctuation in the voltage increases. That is, when an image to be formed has a high printing rate and a corresponding chart has a high density, it is necessary to drive a large number of the piezoelectric elements 46 a large number of times. Accordingly, the current amplifying circuit is required to output a high current. In contrast, when a chart has a low printing rate and low density, the current amplifying circuit is required to output only a minute current.

Figure 6:
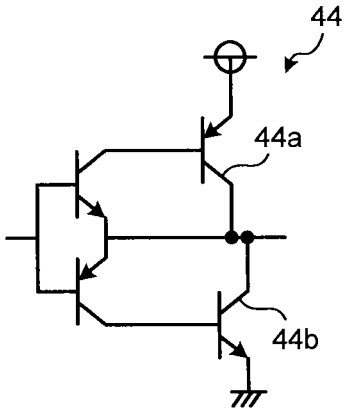
FIG. 6 is a diagram illustrating a circuit configuration of a typical current amplifying circuit.

A circuit configuration of a generic current amplifying circuit is described below with reference to FIG. 6. FIG. 6 is a diagram illustrating the circuit configuration of the generic current amplifying circuit.

A generic current amplifying circuit employs a multi-stage class-B amplifier design using bipolar transistors (hereinafter, abbreviated as "transistors") as does the current amplifier 44 illustrated in FIG. 6. In a case in which a high current is supplied to the piezoelectric elements 46 with an amplifier circuit of this type, it is necessary to supply large collector-emitter currents to a source transistor 44*a* and a sink transistor 44*b* at a later stage of the amplifier circuit. At this time, each of the transistors dissipates power which is a product of a collector-emitter voltage and the collector-emitter current. Accordingly, it is generally required to select components that permit this power dissipation; however, simply selecting transistors having a large allowable dissipation undesirably increases a size and cost of a component. Known countermeasures against this increase in cost include the technique (described above) that uses a plurality of circuits that use relatively less costly transistors and divides the piezoelectric elements 46 into groups so that a load is shared by the current amplifying circuits, thereby preventing an increase in cost.

Figure 7:
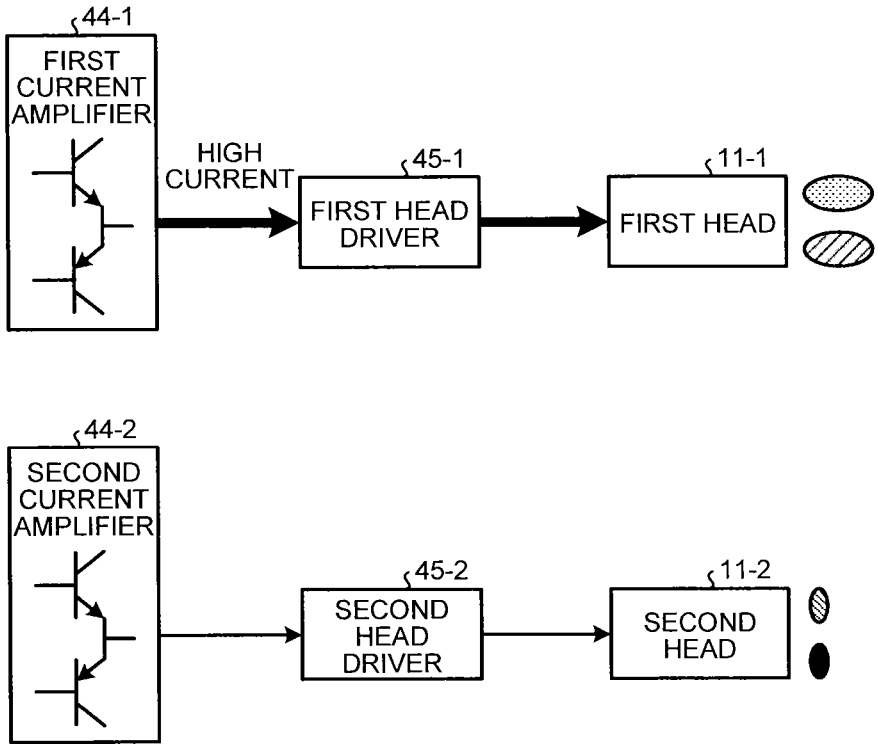
FIG. 7 is a diagram illustrating an imbalance between load currents.

An imbalance between load currents is described below with reference to FIG. 7. FIG. 7 is a diagram illustrating the imbalance between load currents.

It is assumed in this example that the inkjet recording apparatus 1 includes a first head 11-1 and a second head 11-2. The first head 11-1 includes ink discharging nozzles for the colors of magenta (M) and yellow (Y), while the second head 11-2 includes ink discharging nozzles for the colors of cyan (C) and black (K). A first current amplifier 44-1 outputs a drive waveform for driving the first head 11-1, while a second current amplifier 44-2 outputs a drive waveform for driving the second head 11-2. A first head driver 45-1 and a second head driver 45-2 illustrated in FIG. 7 control actuators of the first head 11-1 and actuators of the second head 11-2, respectively. In order for a highly-dense red chart to be printed by this apparatus, large amounts of the M ink and the Y ink must be discharged simultaneously. Therefore, a large load is placed only to the first current amplifier 44-1. On the other hand, if the C ink and the K ink are not to be discharged, it is unnecessary to operate the second current amplifier 44-2. Thus, imbalanced distribution of ink-discharging nozzles can occur depending on an image to be formed, resulting in an occurrence of an imbalance between the current loads on the current amplifiers.

Figure 8:
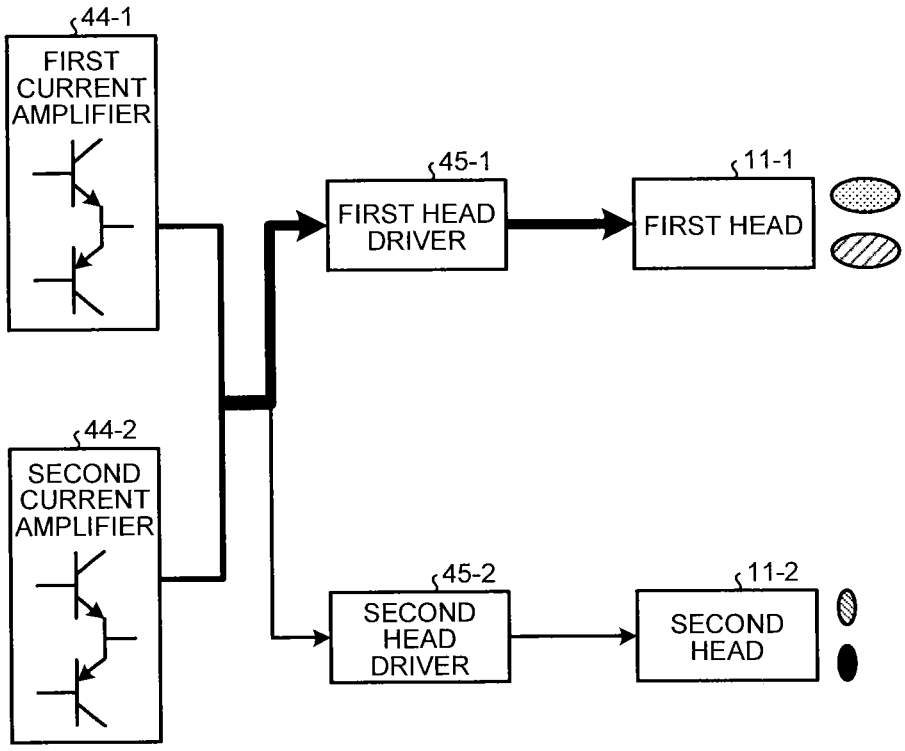
FIG. 8 is a diagram illustrating a circuit configuration capable of equalizing current loads between current amplifiers according to the embodiment.

A circuit configuration according to the present embodiment capable of equalizing current loads between current amplifiers is described below with reference to FIG. 8. FIG. 8 is a diagram illustrating the circuit configuration capable of equalizing the current loads between the current amplifiers. Note that FIG. 8 illustrates an example in which two current amplifiers are used; however, any number of current amplifiers can be employed, and three or more current amplifiers may be used.

Provided in the present embodiment is the inkjet recording apparatus 1 in which a plurality of current amplifiers outputs electric currents with equal current loads irrespective of a chart that is to be printed. More specifically, for instance, when the apparatus including the two current amplifiers 44-1 and 44-2 is used, as illustrated in FIG. 8, two circuits are configured to combine outputs of the current amplifiers 44-1 and 44-2 so as to generate a single drive waveform. Thereafter, the drive waveform is split and input to a plurality of head drivers (in the example illustrated in FIG. 8, the first head driver 45-1 and the second head driver 45-2) to thereby drive the piezoelectric elements 46 serving as actuators in the present embodiment. This configuration makes it possible to supply electrical currents through the two current amplifiers (the first current amplifier 44-1 and the second current amplifier 44-2) even when, for instance, high current loads have occurred only in the units corresponding to the colors of M and Y. In short, this configuration can reduce (reduce by half in the example illustrated in FIG. 8) a current load placed on each of the current amplifiers 44-1 and 44-2. Meanwhile, an emergence of drive waveforms that cause all the actuators of CMYK to output high currents during image formation does not occur because the emergence of such a drive waveforms results in application of excessive amounts of ink onto a print medium. Accordingly, a maximum current to be output from each of the current amplifiers can be reduced by combining outputs of the current amplifiers.

It should be noted that when one drive waveform is generated using a plurality of current amplifiers simultaneously, electrical currents can be concentrated on one or some particular circuits due to variations in component characteristics among the current amplifiers, causing a maximum current of the particular circuit(s) to increase. Hence, a certain load equalizing control is required. In the present embodiment, as will be described later, a plurality of current amplifying circuits, each of which includes only a plurality of bipolar transistors and a plurality of resistors and has a current adjusting function, are connected in parallel with each other to thereby provide a circuit that reduces a maximum current output from each of the current amplifiers (each including the plurality of transistors). This circuit is also configured such that the individual current amplifiers supply electrical currents which are equal in load.

Embodiment 1

Figure 9:
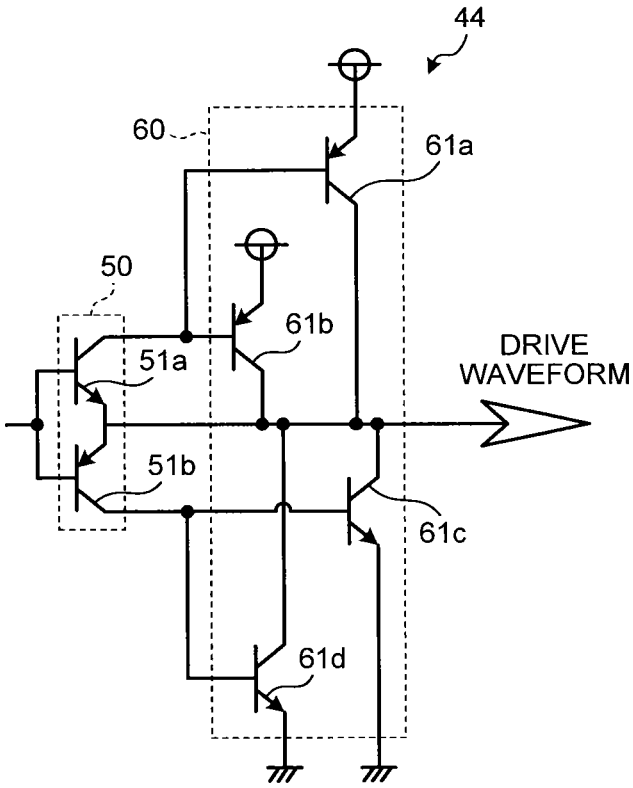
FIG. 9 is a diagram illustrating a current amplifying circuit having a function for adjusting an electric current according to the embodiment.

The configuration of a current amplifying circuit with a current adjusting function is described below as an exemplary embodiment 1 with reference to FIG. 9. FIG. 9 is a diagram illustrating the current amplifying circuit having the current adjusting function.

As a specific configuration, the current amplifying circuit with the current adjusting function has an inverted Darlington system made up of a front stage 50 that includes a common-emitter amplifier circuit formed by front stage transistors 51*a* and 51*b*, and a rear stage 60 that includes at least two common-collector amplifier circuits formed by rear stage transistors 61*a*, 61*b*, 61*c*, and 61*d*. Furthermore, in the rear stage of the configuration, a plurality of the amplifier circuits is connected in parallel with each other. This configuration makes it possible to disperse a current load, thereby yielding an effect of reducing a maximum current to be output from each of the transistors.

Embodiment 2

Figure 10:
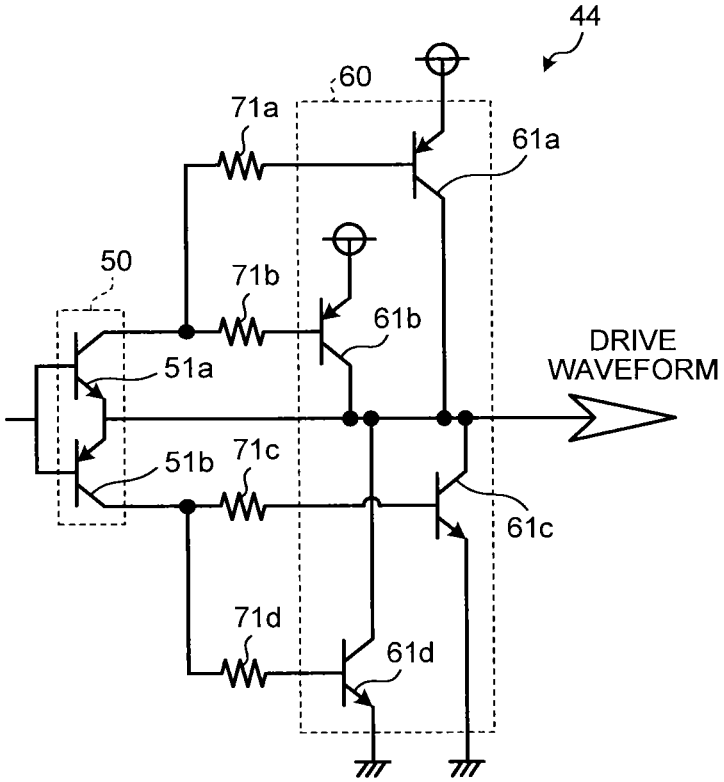
FIG. 10 is a diagram illustrating an arrangement of current-adjusting resistors according to the embodiment.

An arrangement of current-adjusting resistors for equalizing loads in the current amplifying circuit with the current adjusting function is described below with reference to FIG. 10. FIG. 10 is a diagram illustrating the arrangement of the current-adjusting resistors.

A current-adjusting function can be implemented by arranging resistors 71*a*, 71*b*, 71*c*, and 71*d* between the collector terminals of the front stage transistors 51*a* and 51*b* and base terminals of the rear stage transistors 61*a*, 61*b*, 61*c*, and 61*d*. For instance, when one of the rear stage transistors 61*a*, 61*b*, 61*c*, and 61*d* on a source side, or the rear stage transistor 61*a* on the source side, is supplied with a collector-emitter current larger than that of another rear stage transistor 61*b* on the source side, an electrical current that depends on a current gain $h_{FE}$ of the rear stage transistors 61*a* and 61*b* flows. Accordingly, the resistor 71*a* causes a high current, thereby developing a potential difference between the terminals of the resistor 71*a* with an amount corresponding to a product of the current and the resistance across the resistor 71*a*. As a result, a potential difference larger than that between the transistors 51*a* and 61*b* is developed between the transistors 51*a* and 61*a*, acting to reduce an electric current flowing through the rear stage transistor 61*a* (the same holds true for the transistor 61*b* and the transistors on a sink side). Thus, the resistors 71*a*, 71*b*, 71*c*, and 71*d* function as a balancer that reduces a relatively-large electrical current through an amplifier circuit (transistor), thereby equalizing current loads between the circuits.

Embodiment 3

Figure 11:
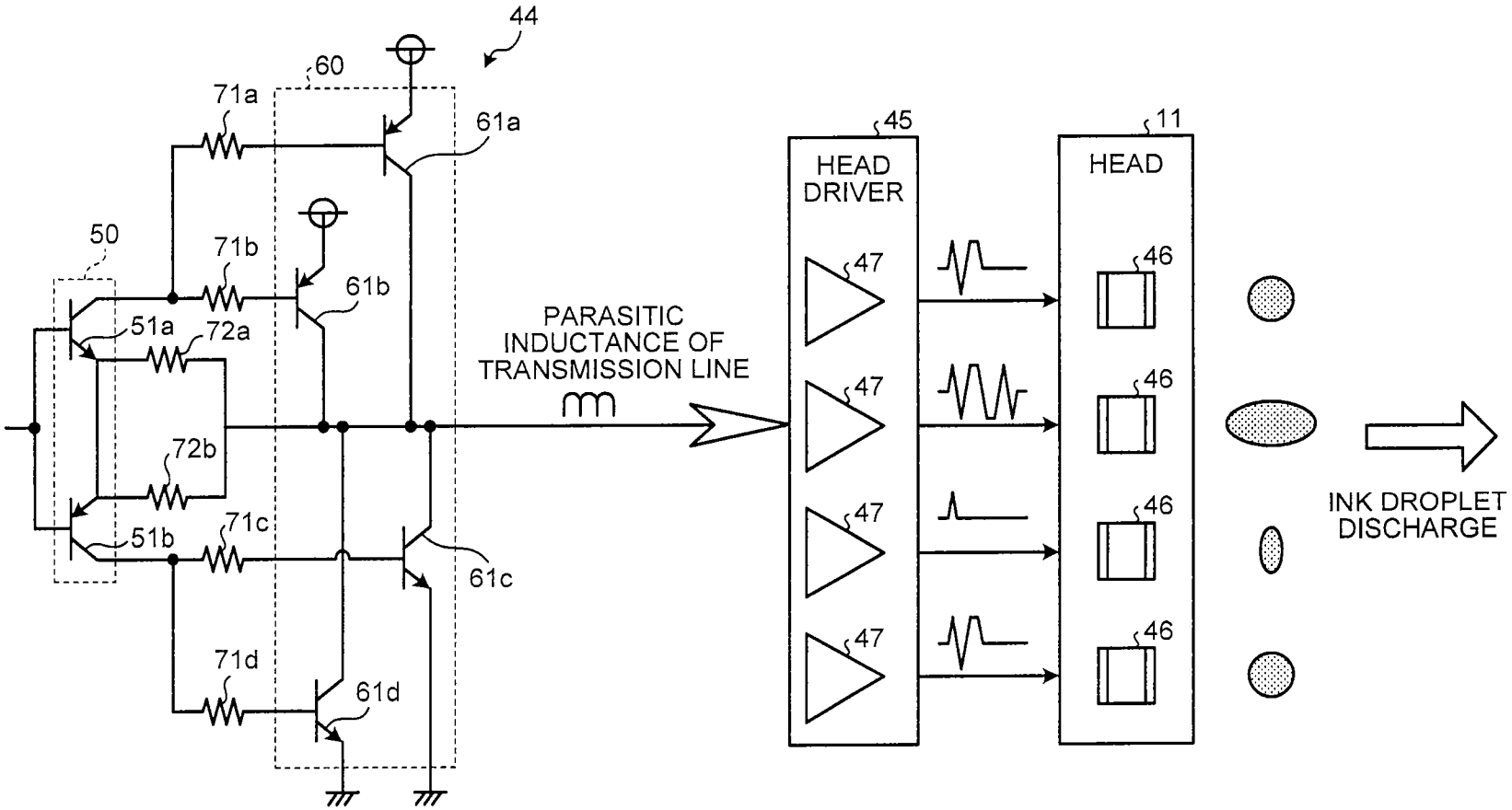
FIG. 11 is a diagram illustrating an arrangement of resistors for suppressing a deformation of a waveform caused by a load fluctuation according to the embodiment.

An arrangement of resistors for suppressing deformation of a drive waveform caused by load fluctuation is described below with reference to FIG. 11. FIG. 11 is a diagram illustrating the arrangement of resistors for suppressing deformation of the drive waveform caused by the load fluctuation.

Using the piezoelectric elements 46 as actuators poses a problem that a shape of a drive waveform varies between cases in which the piezoelectric elements 46 have large capacitance and in which the piezoelectric elements 46 have small capacitance. More specifically, when ink is discharged from a large number of nozzles simultaneously, a large number of switching circuits (analog switches) 47 in the head driver 45 are turned on. Therefore, a combined resistance of the head driver 45 becomes considerably small, which makes a load capacitance of the head driver 45 large, producing an instantaneous high current to the actuators. This high current causes a voltage waveform to be deformed by a parasitic inductance of a transmission line, resulting in abnormal driving of the piezoelectric elements 46.

Employed in view of the circumstance is a configuration in which a resistor 72*a* and a resistor 72*b* are arranged between emitters of the front stage transistors 51*a* and 51*b* and collectors of the rear stage transistors 61*a*, 61*b*, 61*c*, and 61*d*, as illustrated in FIG. 11. Meanwhile, the configuration illustrated in FIG. 11 is obtained by adding the resistors 72*a* and

72*b* to the configuration of the embodiment 2; however, an employable configuration is not limited thereto, and a configuration obtained by similarly adding the resistors 72*a* and 72*b* to the configuration of the embodiment 1 can be employed. With these configurations, a resistance value from the current amplifier 44 to the piezoelectric elements 46 can be maintained to be higher than a certain value even when the number of nozzles to which a driving voltage is simultaneously applied is large, thereby suppressing in-flowing of an instantaneous current. As a result, deformation of a drive waveform can be suppressed.

As described above, the current amplifiers 44 configured using less costly components (transistors and resistors of low rated currents) with a minimum parts count are employed in the image forming apparatus that uses capacitive loads such as the piezoelectric elements 46, of which capacitance values can vary, as ink-discharging actuators. This makes it possible to perform current amplification of a drive voltage to be supplied to the actuators within rated currents of the less costly components. Accordingly, it becomes possible to produce the drive-voltage generating circuit and an entire system of the image forming apparatus at a relatively low cost.

According to an aspect of the present embodiment, in an image forming apparatus that uses a capacitive load as an ink discharging actuator, current amplification of a drive voltage to be supplied to the actuator can be performed within a rated current of a less costly component. Accordingly, there is yielded an effect that a drive-voltage generating circuit and the image forming apparatus including the drive-voltage generating circuit can be produced at a relatively low cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising: a plurality of heads, each of which includes a capacitive load used as an actuator for discharging ink; a drive-voltage generating circuit that outputs a drive voltage to be applied to the actuator and includes a plurality of current amplifying circuits; and a plurality of head drivers each of which controls each of the actuators of the heads, wherein each of the current amplifying circuits is configured to include a plurality of bipolar transistors and to operate so as to equalize output current loads of the bipolar transistors included in the current amplifying circuits, waveforms of the drive voltages output from the current amplifying circuits are combined to form a combined waveform of the drive voltages to be applied to each of the head drivers, each of the current amplifying circuits is a class-B amplifier system that includes a bipolar transistor configured to have an inverted Darlington system that includes: a front stage, which is a common-emitter amplifier circuit that includes a plurality of bipolar transistors; and a rear stage, which is a common-collector amplifier circuit that includes a plurality of bipolar transistors, and at least the rear stage includes the plurality of common-collector amplifier circuits that are connected in parallel with each other.

2. The image forming apparatus according to claim 1, further comprising resistors that are connected between collector terminals of the bipolar transistors in the front stage and base terminals of the bipolar transistors in the rear stage by being paired with base terminals of the bipolar transistors in the rear stage.

3. The image forming apparatus according to claim 1, further comprising resistors, each connected between each of emitter terminals of the bipolar transistors in the front stage and all collector terminals of each of the bipolar transistors in the rear stage.

4. A drive-voltage generating circuit that outputs a drive voltage to be applied to an actuator which is used as a capacitive load for discharging ink in an image forming apparatus, the image forming apparatus having a plurality of heads, and each of the heads being driven by the actuator, the drive-voltage generating circuit comprising: a plurality of current amplifying circuits, wherein each of the current amplifying circuits is configured to include a plurality of bipolar transistors and to operate so as to equalize output current loads of the bipolar transistors included in the current amplifying circuits, waveforms of the drive voltages output from the current amplifying circuits are combined to form a combined waveform of the drive voltages to be applied to each of the head drivers, the current amplifying circuits adopts a class-B amplifier system that includes a bipolar transistor and is configured to have an inverted Darlington system that includes: a front stage, which is a common-emitter amplifier circuit that includes a plurality of bipolar transistors; and a rear stage, which is a common-collector amplifier circuit that includes a plurality of bipolar transistors, and at least the rear stage includes the plurality of common-collector amplifier circuits that are connected in parallel with each other.

5. The drive-voltage generating circuit according to claim 4, further comprising resistors that are connected between collector terminals of the bipolar transistors in the front stage and base terminals of the bipolar transistors in the rear stage by being paired with base terminals of the bipolar transistors in the rear stage.

6. The drive-voltage generating circuit according to claim 4, further comprising resistors, each connected between each of emitter terminals of the bipolar transistors in the front stage and collector terminals of all the bipolar transistors in the rear stage.

* * * * *